US008089415B1

(12) United States Patent
West

(10) Patent No.: US 8,089,415 B1
(45) Date of Patent: Jan. 3, 2012

(54) MULTIBAND RADAR FEED SYSTEM AND METHOD

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 636 days.

(21) Appl. No.: 12/236,467

(22) Filed: Sep. 23, 2008

(51) Int. Cl.
*H01Q 3/00* (2006.01)

(52) U.S. Cl. ..... 343/776; 343/777; 343/778; 333/21 R

(58) Field of Classification Search ..... 343/756, 343/777, 776, 786, 762, 778, 909
See application file for complete search history.

(56) References Cited

U.S. PATENT DOCUMENTS

| | | | | |
|---|---|---|---|---|
| 3,665,481 | A * | 5/1972 | Low et al. | 343/762 |
| 5,638,944 | A | 6/1997 | Diebel et al. | |
| 5,907,797 | A | 5/1999 | Hanatatsu et al. | |
| 6,323,819 | B1 | 11/2001 | Ergene | |
| 6,720,932 | B1 | 4/2004 | Flynn et al. | |
| 7,102,581 | B1 | 9/2006 | West | |

OTHER PUBLICATIONS

Marcuvitz, N., *Waveguide Handbook*, 1986, cover page and pp. 66, 71, 72, 79,.Peter Peregrines, Ltd., London, UK.

Kildal, P.S. et al., Artificially Soft and Hard Surfaces in Electromagnetics and Their Application, *IEEE Antennas and Propagation Society International Symposium AP_S Digest*, Jun. 1986, pp. 832-835.

Kildal, P.S., "Relationship Between Surface Impedance and Bandwidth of Hard Surface," *IEEE Antennas and Propagation Society International Symposium AP_S Digest*, Mar. 1994, pp. 1460-1463.

* cited by examiner

*Primary Examiner* — Dieu H Duong
(74) *Attorney, Agent, or Firm* — Donna P. Suchy; Daniel M. Barbieri

(57) ABSTRACT

A feed for an antenna configured for use with a radar system or a satellite communication system is configured to operate in multiple bands. The feed comprises a plurality of concentric waveguides. The feed further comprises a first pair of diametrically opposed probes forming a first axis and electrically coupled to at least one of the plurality of concentric waveguides. The feed further comprises a second pair of diametrically opposed probes forming a second axis and electrically coupled to the at least one of the plurality of concentric waveguides. The first and second axis are orthogonal and the first and second pairs of diametrically opposed probes are configured to generate a sum beam and difference beam in the at least one of the plurality of concentric waveguides.

20 Claims, 10 Drawing Sheets

MULTIBAND RADAR FEED SYSTEM AND METHOD

CROSS-REFERENCE TO RELATED PATENT APPLICATIONS

This application is related to U.S. Pat. No. 7,102,581, the entirety of which is herein incorporated by reference.

BACKGROUND

The present disclosure relates generally to the field of antennas. More specifically, the present disclosure relates to antenna feeds.

Contemporary military satellite communication (SATCOM) systems require cost-effective, light-weight, low-mass, multiband and polarization-agile antenna apertures. Specific SATCOM bands of current interest include C-band, X-band, Ku-band (10.7-12.7 GHz), K-band (20-22 and 29-31 GHz) and Q-band (43-45 GHz) for various military and commercial SATCOM systems. In addition, the ability to receive orthogonal polarized signals within the same band is a requirement for military SATCOM systems. An example of this is the requirement to simultaneously receive SCAMP MILSTAR (21-GHz right-hand circular polarization (RHCP)) and Global Broadcast System (GBS) video links (21-GHz left-hand circular polarization (LHCP)).

With a traditional waveguide feed (e.g., a metallic waveguide feed) of an antenna (e.g., a reflector antenna), the ability of the feed to have more than two bands is difficult. Multiband feeds can be mechanically large and therefore initiate excessive aperture blockage for many reflector applications. The feed assemblies are mechanically complex and difficult to manufacture, which adds to weight and cost. Such feeds are capable of circular polarization only and limited to two frequency bands.

Cluster feeds are commonly used on large satellite reflectors. They are mechanically complex and are not suitable for moderate and small-sized reflectors due to large aperture blockage.

A need exists for a low-cost, physically compact multiband reflector antenna feed for multiband polarization-agile communications-on-the-move and other microwave/millimeter wave multiband SATCOM systems.

Currently, multiple feed horns are required to operate a single reflector aperture in multiple SATCOM bands. Band changeover requires either a mechanical actuation (for fixed site installations) or an operator to remove and install a new feed horn for each band. A need exists for reducing the multiple feed horns into a single radiator in order to reduce cost and weight and improve system response time.

It would be desirable to provide a system and/or method that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY

One embodiment of the disclosure relates to a feed for an antenna configured for use with a radar system or a satellite communication system. The feed is configured to operate in multiple band and comprises a plurality of concentric waveguides. The feed further comprises a first pair of diametrically opposed probes forming a first axis and is electrically coupled to one of the plurality of concentric waveguides. The feed further comprises a second pair of diametrically opposed probes forming a second axis and is electrically coupled to the one of the plurality of concentric waveguides. The first axis and second axis are orthogonal and the first and second pairs of diametrically opposed probes are configured to generate a sum beam and a difference beam in the at least one of the plurality of concentric waveguides.

Another embodiment of the disclosure relates to a method for generating a sum and difference beam in an antenna feed for an antenna configured for use with a radar system or a satellite communication system. The feed is configured to operate in multiple bands. The feed has a plurality of concentric waveguides, a first pair of diametrically opposed probes forming a first axis and electrically coupled to one of the plurality of concentric waveguides, and a second pair of diametrically opposed probes forming a second axis and electrically coupled to the one of the plurality of concentric waveguides. The first and second axis are orthogonal. The method comprises generating a sum beam and a difference beam in the at least one of the plurality of concentric waveguides.

Yet another embodiment of the disclosure relates to an apparatus for generating a radar beam in an antenna. The antenna configured for use with a radar system or a satellite communication system. The disclosure includes a plurality of concentric waveguides, a first pair of diametrically opposed probes forming a first axis and electrically coupled to one of the plurality of concentric waveguides, and a second pair of diametrically opposed probes forming a second axis and electrically coupled to the one of the plurality of concentric waveguides. The first axis and second axis are orthogonal. The apparatus also includes means for exciting both probes of the first pair of diametrically opposed probes in phase with each other and exciting both probes of the second pair of diametrically opposed probes in phase with each other at a first time period. The apparatus also includes means for exciting both probes of the first pair of diametrically opposed probes out of phase with each other and exciting both probes of the second pair of diametrically opposed probes out of phase with each other at a second time period. The apparatus also includes means for switching between the sum beam and the difference beam in the at least one of the plurality of concentric waveguides to generate a monopulse signal.

Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF THE EXEMPLARY EMBODIMENTS

Figure 1:
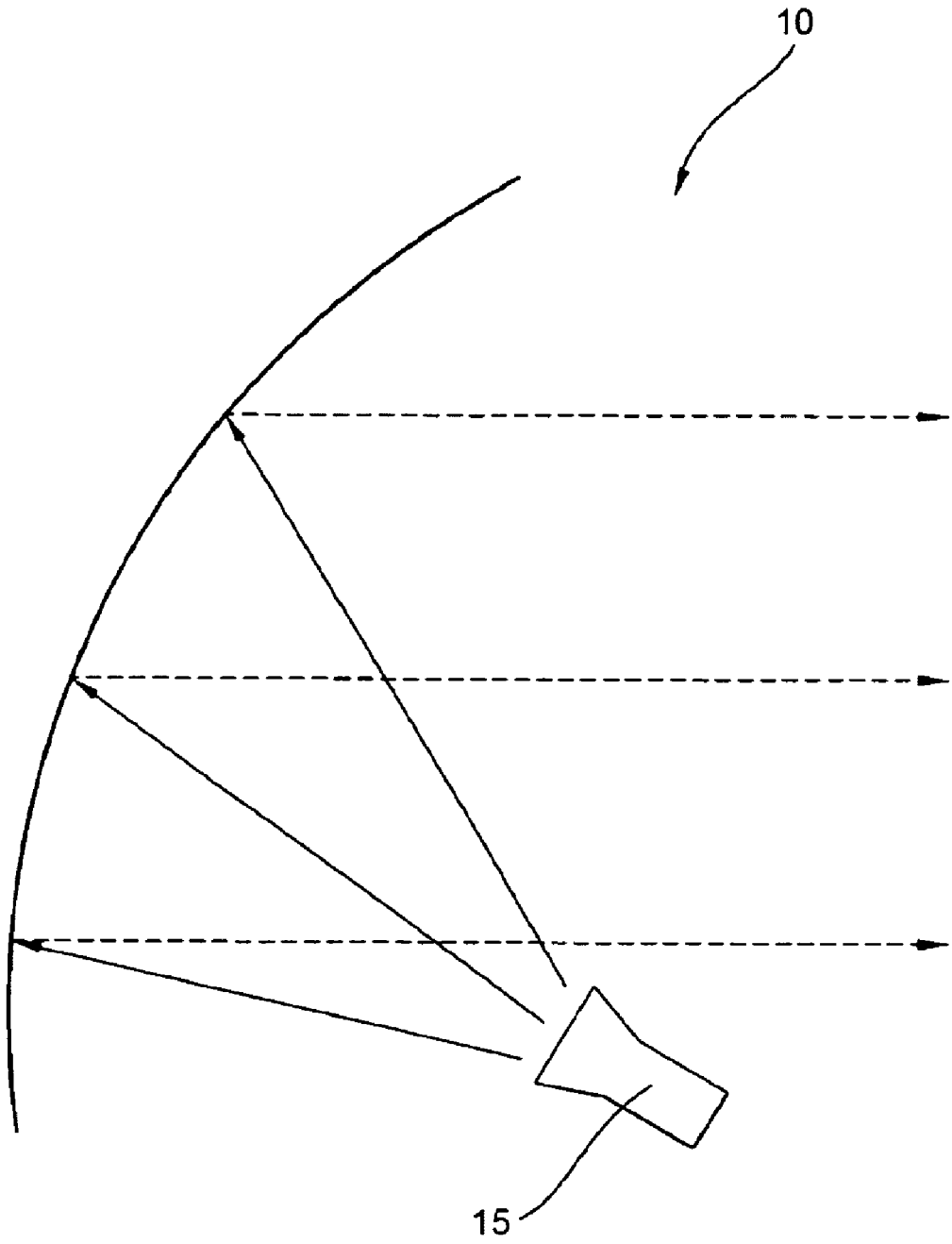
FIG. 1 is a diagram of a traditional waveguide feed for an antenna, according to an exemplary embodiment.

Before describing in detail the particular improved system and method, it should be observed that the invention includes, but is not limited to, a novel structural combination of components, and not in the particular detailed configurations thereof. Accordingly, the structure, methods, functions, control and arrangement of the components have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Referring generally to the figures, various feeds are described where the feed is used in an antenna. The antenna may be configured for use on an aircraft or other airborne object, on a land vehicle, on portable equipment, as a "man packable" equipment, for maritime or another water vehicle, for a space vehicle, etc. The antenna is used for satellite communication or for radar transmission and reception, according to an exemplary embodiment.

Referring to FIG. 1, a traditional feed 15 for an antenna 10 is shown. Feed 15 may be a metallic waveguide feed and antenna 10 may be a reflector antenna. In the embodiment of FIG. 1, feed 15 is not capable of having more than three bands.

Referring generally to FIGS. 2-7, the present invention is for a feed of an antenna that is high-efficiency, multiband, and polarization-agile. The feed may be for prime focus, Cassegrain, Gregorian, offset reflector, or multiple reflector antennas. Referring generally to FIGS. 8-12, a monopulse extension of the feed embodiments of FIGS. 2-7 is described. The result of the monopulse extension is a simultaneous multiband antenna operation from a feed horn (e.g., a single electrically small feed horn) that supports sum beam and difference (monopulse) modes or beams. Further, the concentric stacking of waveguides allows for multiple independent feed horns of the antenna. The integrated monopulse capability greatly enhances satellite acquisition and tracking for narrow beam width antennas.

Figure 2:
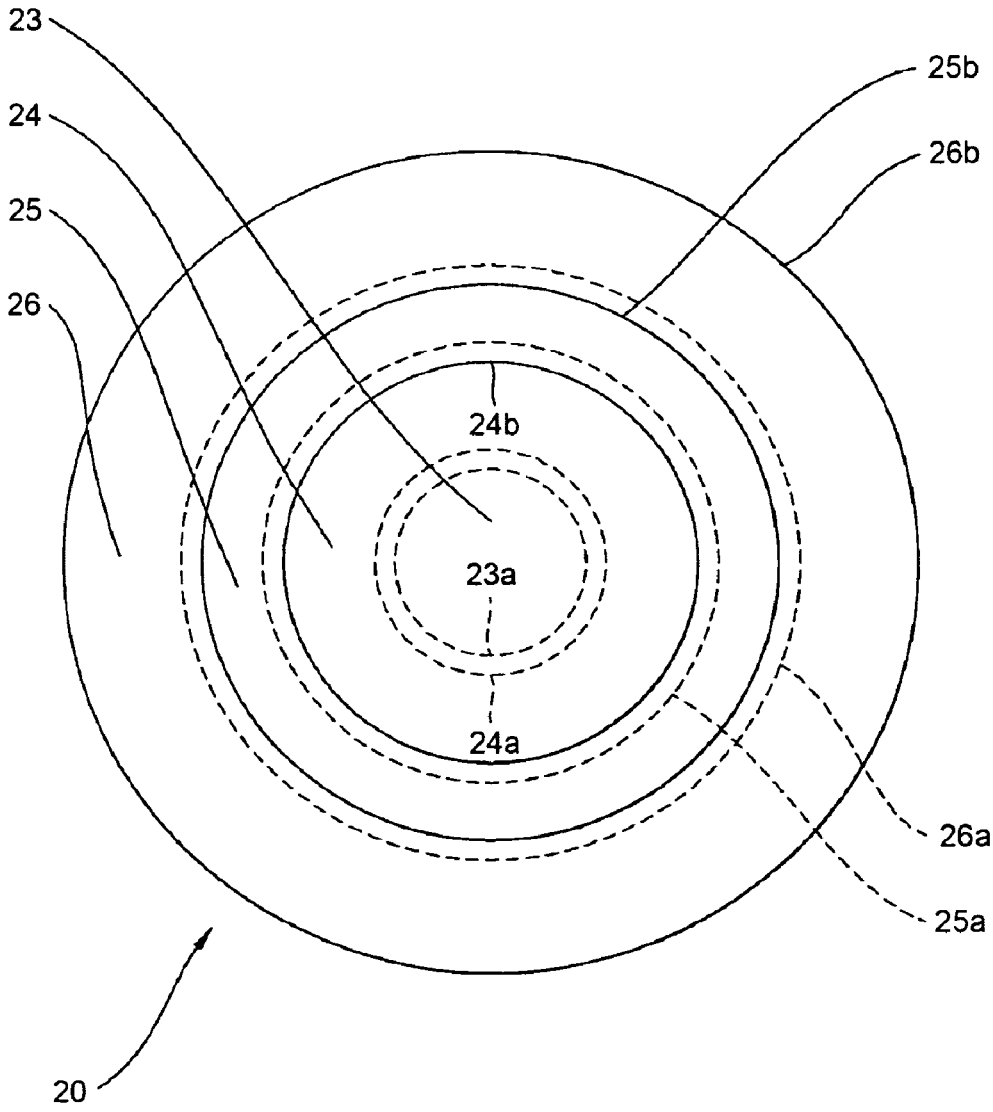
FIG. 2 is a front view of a multiband waveguide feed, according to an exemplary embodiment.
Figure 3:
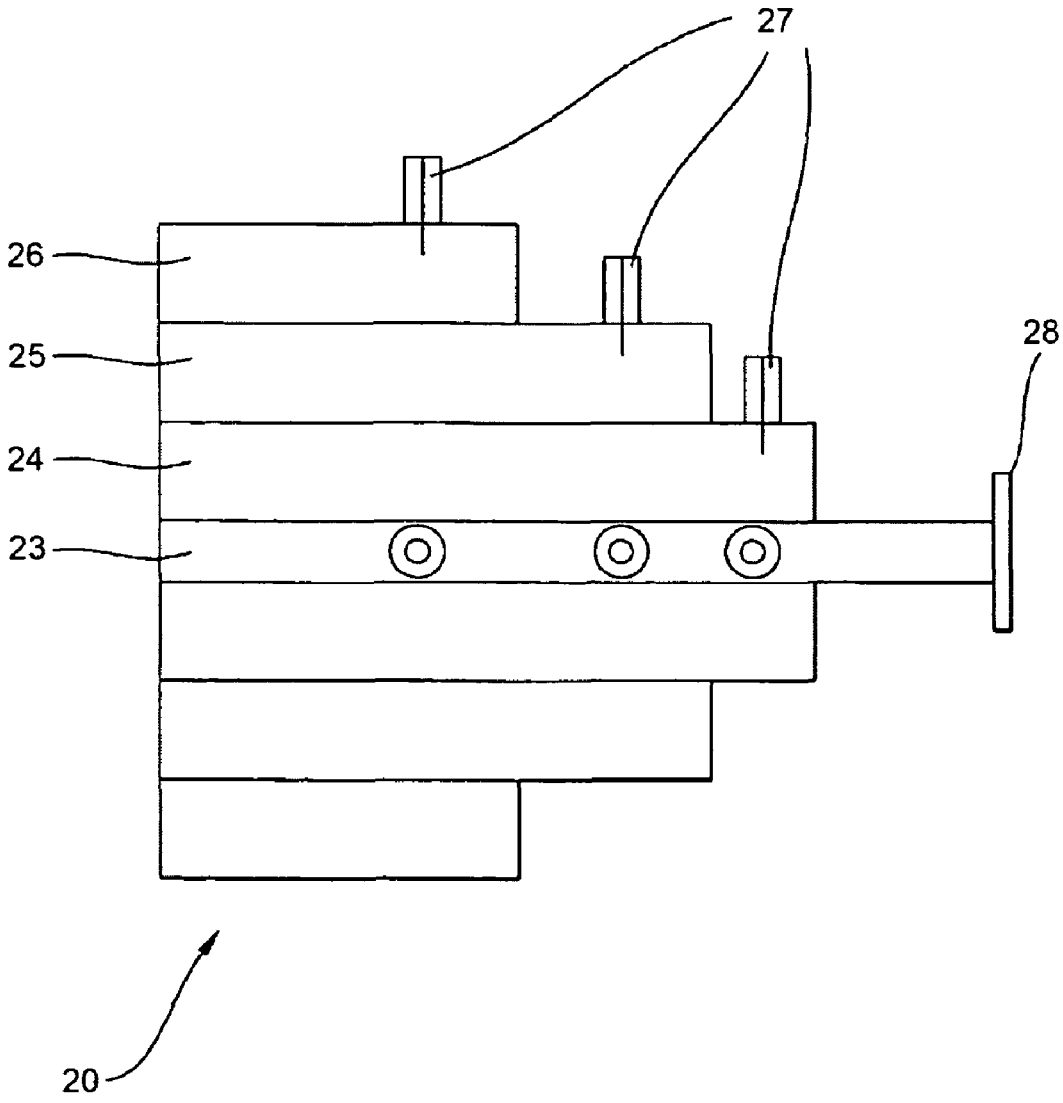
FIG. 3 in a side view of the multiband waveguide feed of FIG. 2, according to an exemplary embodiment.

An antenna feed 20 of the present invention is shown in a front view in FIG. 2 and a side view in FIG. 3, according to an exemplary embodiment. Feed 20 may be a waveguide feed of a reflector antenna, according to an exemplary embodiment. Feed 20 is a multiband feed capable of having two, three, or more bands, unlike feed 15 of FIG. 1. In FIGS. 2 and 3, four waveguides of feed 20 are shown in a concentric architecture. Other number of feeds may be incorporated in feed 20 by adding or deleting circular waveguides, according to an exemplary embodiment. For example, referring generally to FIGS. 8-12, other feed configurations are shown with two or three waveguides instead of four.

A first band waveguide 23 is shown in the center of feed 20 and has an outer conductor 23*a*. A second band waveguide 24 is the next ring outward from first band waveguide 23 and may operate as a coaxial waveguide with an outer conductor 24*b*. The outer surface of first band waveguide 23 may serve as the inner conductor 24*a* of second band waveguide 24. A third band waveguide 25 is the next ring outward from second band waveguide 24 and may operate as a coaxial waveguide with an outer conductor 25*b*. The outer surface of second band waveguide 24 may serve as the inner conductor 25*a* of third band waveguide 25. A fourth band waveguide 26 is the outer ring as shown in FIG. 2 and operates as a coaxial waveguide with an outer conductor 26*b*. The outer surface of third band waveguide 25 may serve as the inner conductor 26*a* of fourth band waveguide 26.

Waveguide input 28 of FIG. 3 is used to feed first band waveguide 23 and transitions 27 may be used to feed other waveguides 24, 25, 26. Transitions 27 may be waveguide-to-coax transitions (e.g., coaxial input ports), according to an exemplary embodiment. According to an alternative embodiment, impedance matched waveguide sections (not shown in the figures) instead of coaxial input ports 27 may be utilized as input ports for waveguides 24, 25, 26. The input waveguide sections typically couple to their respective waveguides or ring sections 23, 24, 25, 26 through coupling slots or irises, according to an exemplary embodiment.

Feed 20 may be a waveguide structure that is coaxial and metallic, according to an exemplary embodiment. The structure may approximate a perfect electrical conductor (PEC), an electromagnetic band gap (EBG) structure that approximates a perfect magnetic conductor (PMC), or a combination of the two across the various bands of feed 20. The PEC and PMC can be approximated by using printed circuit EBG surfaces, dielectric material loaded waveguide corrugations, or other embodiments. In FIG. 2, metallic PECs are illustrated as solid concentric rings 24*b*, 25*b*, and 26*b* (as the outer conductors of waveguides 24, 25, 26). EBG structures (e.g., PMCs) are illustrated as dashed concentric rings 23*a*, 24*a*, 25*a*, 26*a* (as the inner conductors of waveguides 23, 24, 25, 26).

EBG materials are periodic surfaces that become a high impedance open circuit to incident waves at a resonant frequency. The surface impedance of a given EBG physical embodiment is a function of frequency. When waveguide structures are lined with EBG materials, the waveguide propagation characteristics change as a function of the surface impedance. The EBG substrate material may be monolithic GaAs, ferroelectric, ferromagnetic, or any suitable EBG flexible printed circuit embodiment. An electromagnetic hard EBG surface may also be realized by air filled or dielectric filled axial corrugations on the conductor surfaces of the waveguides.

Figure 5:
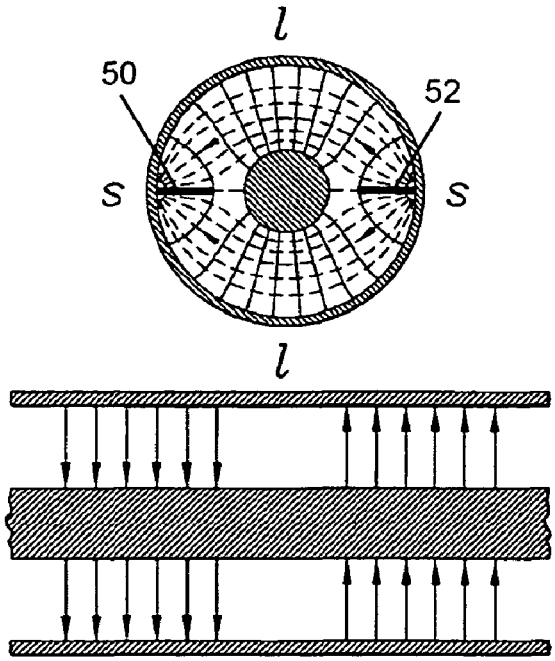
FIG. 5 shows a higher ordered waveguide $TE_{11}$ mode operation for a waveguide of the feed of FIG. 2, according to an exemplary embodiment.
Figure 6:
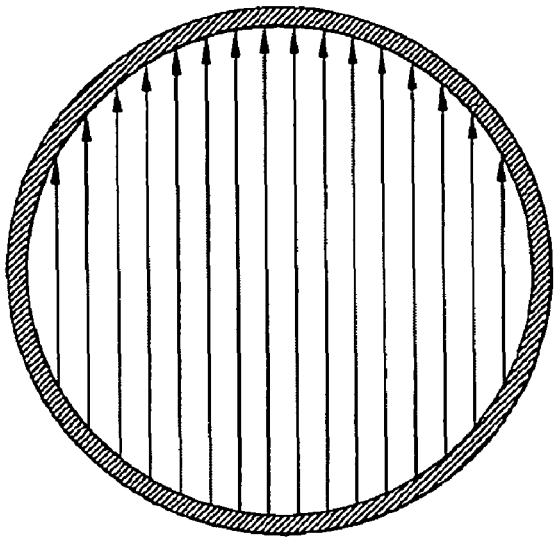
FIG. 6 is a diagram showing a waveguide transverse electromagnetic mode pattern for the feed of FIG. 2, according to an exemplary embodiment.
Figure 7:
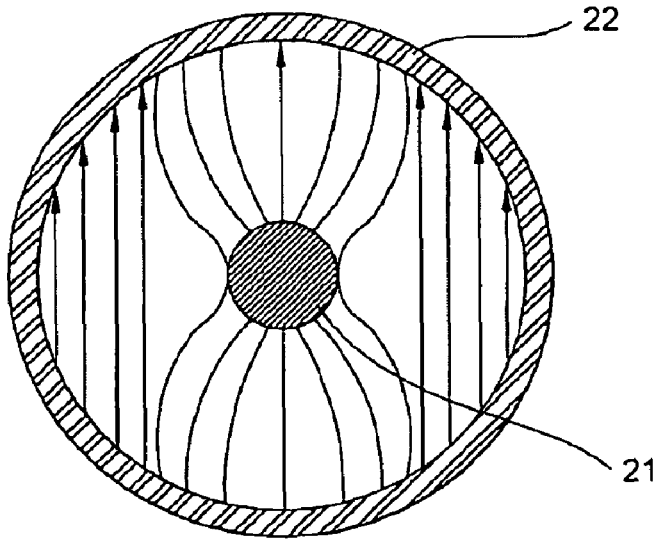
FIG. 7 is a diagram showing a coaxial waveguide mode pattern for the feed of FIG. 2, according to an exemplary embodiment.
Figure 8:
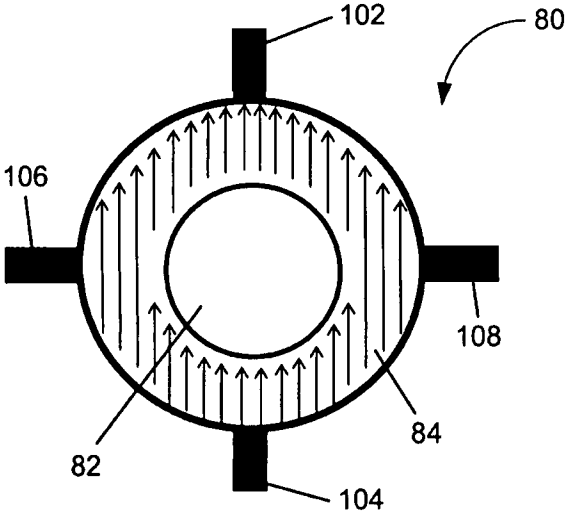
FIG. 8 is a diagram of a sum mode pattern for a feed with two waveguides, according to an exemplary embodiment.

According to a first preferred embodiment, the inner waveguide of feed 20 may be in a $TE_{11}$ mode (described below) and the remaining waveguides in a uniform vertical electric field mode as shown in FIGS. 6 and 8. According to a second preferred embodiment, the inner waveguide and other waveguides of feed 20 operate in a uniform vertical electric field mode as shown in FIGS. 6 and 8. According to alternative exemplary embodiments, feed 20 may be in an all metallic coaxial $TE_{11}$ mode, a mode as shown in FIG. 5, or in the quasi-TEM mode of FIG. 7 where the inner surface of the outer coax 22 is EBG and the surface of the inner coax 21 is metallic, or otherwise.

According to a first embodiment of the present invention, feed 20 may consist of a highest frequency $TE_{11}$ waveguide structure, according to an exemplary embodiment. The $TE_{11}$ mode is a lowest frequency electric and magnetic field configuration within the metal walled waveguide that propagates non-evanescent energy for a given waveguide cross section. Other modes described in the present disclosure relate to electric and magnetic field structures within the cross section of the waveguides. The modes are require to propagate energy through the waveguides. A given waveguide may theoretically operate in many modes. The $TE_{11}$ waveguide structure may consist of first band 23 surrounded by rings of $TE_{11}$ waveguide sections for the other lower band frequencies (bands 24, 25, 26). The EBG structures are shown as dashed concentric rings 23*a*, 24*a*, 25*a*, 26*a*.

Figure 4:
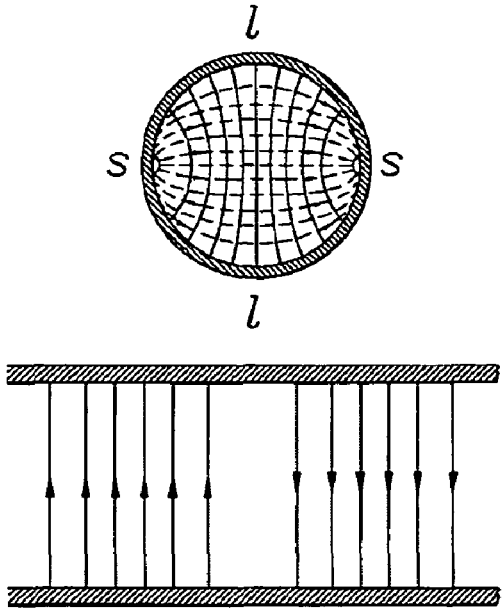
FIG. 4 shows a standard waveguide $TE_{11}$ mode operation for a waveguide of the feed of FIG. 2, according to an exemplary embodiment.

In the standard $TE_{11}$ first band waveguide 23 operates as shown in FIG. 4. The cutoff frequency for the $TE_{11}$ mode is:

$$f_{cTe11} = \frac{2c}{1.640a} \quad \text{(Equation 1)}$$

c=the speed of light and a=the waveguide radius.

The optimal radius of waveguide 23 may be chosen in order to minimize insertion loss, maximize the separation of out-of-band spurious circular waveguide modes, and to obtain desired radiation pattern characteristics (e.g., sum beam beam width, etc.).

An EBG waveguide may have no frequency cutoff phenomenon within the frequency band of the EBG surface. This allows for the creation of propagating modes independent of the waveguide cross-sectional dimension, to a first order, for a given frequency band. It is therefore possible to create a uniform vertical electric field mode for the waveguide, independent of cross section, as depicted in FIG. 6. The EBG electromagnetic hard surfaces operate over a 10-20% bandwidth, which is sufficient for multiband SATCOM applications.

According to an exemplary embodiment, the remaining waveguides 24, 25, 26 are implemented in coaxial uniform vertical electric field mode configurations shown in FIG. 6 for the hollow inner waveguide and FIG. 8 for the outer concentric ring sections. A fundamental (lowest frequency) mode of feed 20 is a transverse electromagnetic (TEM) mode, the mode normally associated with the coaxial cable transmission line when both the inner and outer coaxial sections are metallic (not excited in the present application). A suppressor device (e.g., metal vanes) for the TEM may be implemented if necessary. The mode of second band waveguide 24 are preferably the uniform vertical polarized E field shown in FIG. 8.

Other waveguides 25, 26 may be a $TE_{11}$ mode (e.g., a metallic coaxial waveguide mode) as shown in FIG. 5. The cutoff frequency for the mode is:

$$f_{cCoaxTe11} = \frac{2c}{1.873\Pi(b+a)} \quad \text{(Equation 2)}$$

where c=the speed of light, a=the radius of the waveguide, and b=the radius of the inner waveguide. The cross sectional dimension for an all metallic waveguide (of FIG. 5) is chosen to remain above the cutoff frequency (determined by Equation 2) to achieve the desired radiation characteristics (i.e., beam width, etc.). According to an exemplary embodiment, the waveguide radius is three times greater than the radius of the inner waveguide (a=3b). Similar ratios between the radii may be derived. In addition, cutoff frequencies may be predicted with electromagnetic (EM) computer simulations tools.

Circular polarization can be realized between two waveguides with $TE_{11}$ modes that are superpositioned and shifted in phase by 90 degrees, according to an exemplary embodiment. Polarizations such as dual orthogonal linear polarization, right hand circularly polarized (RHCP) and left hand circularly polarized (LHCP), and arbitrarily orientated linear polarization are possible.

One representative set of dimensions for multiband operation in feed 20 is illustrated in Table 1 below. The multiband operation data shown in Table 1 is for metallic modes, according to an exemplary embodiment. The analysis of Table 1 is based on mode considerations for a coaxial a/b ratio of 1.5. Optimal feed radiation patterns for reflector illumination is not considered in this analysis.

Each coaxial section's (e.g., waveguides 24, 25, 26) operating bandwidth is well above cutoff frequency. The modes can operate within the respective band waveguides, but the modes are difficult to excite and sustain. It is also possible to dielectrically load the waveguide as a design parameter to adjust the aperture size for radiation performance.

TABLE 1

$TE_{11}$ Waveguide modes for the All-Metallic Embodiment

| Freq. Band, GHz | "b", in. | "a", in. | $TE_{11}$ mode cut off, GHz | $f_o/f_{co}$ |
|---|---|---|---|---|
| 43-45 | N/A | 0.275 | 12.66, circular waveguide | 3.5 |
| 29-31 | 0.275 | 0.4125 | 5.5, coax | 5.45 |
| 19-21 | 0.4125 | 0.6188 | 3.66, coax | 5.47 |
| 10-12 | 0.6188 | 1.2375 | 2.44, coax | 4.5 |

According to a preferred embodiment of the present invention, EBG or PMC surfaces (e.g. hard surfaces) are utilized for waveguide surfaces (as shown by dashed rings 23*a*, 24*a*, 25*a*, 26*a*). Inner conductors 24*a*, 25*a*, 26*a* and outer conductors 23*a*, 24*b*, 25*b*, 26*b* may be PECs or PMCs (EBGs) for possible mode options for waveguides 23, 24, 25, 26. According to one embodiment, waveguide 23 is an all metallic $TE_{11}$ mode (as shown in FIG. 4) in the preferred embodiment, and waveguides 24, 25, 26 are of an EBG mode (as shown in FIG. 8) in the preferred embodiment.

Inner conductors 24*a*, 25*a*, and 26*a* and outer conductors 23*a*, 24*b*, 25*b*, and 26*b* may be metallic PECs or PMCs (EBGs) as described below for possible waveguide mode options for waveguides 23, 24, 25, and 26 of FIG. 2. According to an exemplary embodiment, the mode option may be a uniform linearly polarized electric field mode for waveguide 23 with EBG surface outer conductor 23*a* as shown in FIG. 6. According to another exemplary embodiment, the mode option may be a uniform linearly polarized electric field mode for waveguides 24, 25, 26 if the outer conductors (24*b*, 25*b*, 26*b*) and inner conductors (24*a*, 25*a*, 26*a*) are EBG surfaces. The field structure may then be similar to the embodiment shown in FIG. 8. According to yet another exemplary embodiment, the mode option is a circular waveguide-like $TE_{11}$, mode for waveguides 24, 25, 26 whose outer conductors (24*b*, 25*b*, 26*b*) are PECs and whose inner conductors (24*a*, 25*a*, 26*a*) are PMCs (EBGs). The field structure may then be similar to that of FIG. 4. According to yet another exemplary embodiment, the mode option is a quasi-TEM waveguide mode for waveguides 24, 25, 26 whose outer conductors (24*b*, 25*b*, 26*b*) are PMCs (EBGs) and inner conductors (24*a*, 25*a*, 26*a*) are PECs 21, as shown in FIG. 7. The mode of FIG. 7 includes a passive EBG wall and conductor 22 (e.g., a metallic center conductor).

Referring to FIG. 2, dashed rings 23*a*, 24*a*, 25*a*, and 26*a* represent the EBG surface impedance at its resonant (high impedance) condition, which to a first order is a perfect magnetic conductor (PMC). Unlike a perfect electrical conductor (PEC), a PMC can sustain a tangential electric field. This allows a coaxial section (e.g., the waveguides) of FIGS. 2 and 3 to sustain a TEM field pattern as shown in FIGS. 6 and 8 when the inner and outer conductor coaxial EBG surfaces are resonant.

Solid black rings 24*b*, 25*b*, and 26*b* also represent the EBG for an off-frequency or out-of-band (off resonance) impedance that can be designed to operate as a PEC, (e.g., a low impedance metallic surface). For example, if waveguide 26 is operating within a frequency band in which EBG inner conductor 26*a* is resonant (dashed black), and outer conductor 26*b* is PEC (solid black), waveguide 26 can sustain a metallic circular waveguide $TE_{11}$ mode similar to FIG. 4 in spite of the fact that concentric rings are present within the waveguide interior. When EBG inner conductor 26*a* is out-of-band, the waveguide operates in the metallic coaxial $TE_{11}$, mode, with its commensurate cutoff frequency.

The fundamental mode of the all-metallic coaxial structure is the transverse electromagnetic (TEM) mode, (not excited for this application). The first higher ordered metallic coaxial waveguide modes are again described by Equation 2. Similar expressions can be derived for different a/b ratios. In addition, cutoff frequencies can be predicted with contemporary EM computer simulations tools.

If waveguide 26 has resonant EBG surfaces on inner conductor 26*a* and outer conductor 26*b*, a uniform linearly polarized electric field exists as shown in FIGS. 6 and 8. If waveguide 26 has a resonant PEC surface on inner conductor 26*a* and a PMC surface on outer conductor 26*b*, then a quasi-TEM mode exists as shown in FIG. 7.

With the second embodiment, modes can be mixed and matched across the separate frequency band waveguides (different sections of feed 20). For example, in a circular waveguide structure of feed 20, a uniform linearly polarized electric field mode produces a high aperture efficiency and lower cross polarization but also produces higher side lobe levels. In contrast, the $TE_{11}$ mode produces lower side lobes levels but also lower aperture efficiency and lower gain.

The second embodiment provides the ability to optimally adjust the radiation pattern for each frequency band waveguide for proper reflector surface illumination by means of EBG-based waveguide surfaces since there is no constraint of waveguide cutoff as long as the EBG sections are resonant to the PMC boundary condition.

With the second embodiment, dual-band operation within each individual feed waveguide section (e.g., individual waveguides 24, 25, 26, etc.) is implemented by combining all metallic waveguide modes with EBG waveguide modes, each operating in different frequency bands. In the second embodiment, an EBG surface on an outer conductor sets the lower frequency region and an EBG surface on an inner conductor sets the higher frequency region of a given waveguide cross section. When the EBG surface is resonant to the PMC condition, the all-metallic waveguide cutoff phenomenon does not exist. When the EBG is out-of-band, it can be designed to function as a PEC at a higher frequency region to sustain the all-metallic waveguide mode. This concept is equally applicable to a circular $TE_{11}$ waveguide and coaxial waveguide cross sections. As an example, consider the 29- to 31-GHz coaxial $TE_{11}$ ring shown in Table 1. The cutoff frequency is 5.5 GHz for the all-metallic coaxial waveguide $TE_{11}$ mode. An EBG surface can be designed to be resonant to 3.0 GHz, but be a PEC at 5.5 GHz. This will realize a second operating band centered at 3.0 GHz that would be normally cutoff in the all-metallic coaxial waveguide mode.

Feed 20, as shown in FIG. 2, enables a method to integrate low-noise amplifiers, power amplifiers, or transmit/receive modules directly to feed 20 to minimize transmission line loss between feed 20 and the transceiver of the antenna associated with feed 20. It is also possible to have a waveguide input to each concentric ring section of feed 20.

Since the resonant EBG waveguide mode approximates the uniform linearly polarized field waveguide mode, by means of the uniform linear polarized electric field as shown in FIGS. 6 and 8, circular polarization can be realized by the superposition of two spatially orthogonal modes electrically shifted in phase by 90 degrees, as in the case of the all metallic $TE_{11}$ circular waveguide. It is possible to realize dual orthogonal linear polarization, right-hand circularly polarized (RHCP) and left-hand circularly polarized (LHCP), and arbitrarily orientated linear polarization with an appropriate phasing network. The polarization is described in further details in FIGS. 8-10.

The EBG surfaces described herein can be realized at least three ways: a striped EBG microstrip circuit surface in flexible printed wiring board that can be formed to be conformal with, and bonded to the cylindrical waveguide surfaces; air filled longitudinal corrugations may be placed on the waveguide inside wall; and dielectrically loaded longitudinal corrugations may be placed on the waveguide inside wall to create an electromagnetic hard surface. Other embodiments apply to the same general principals.

According to an exemplary embodiment, the waveguides are concentric and circular; according to other exemplary embodiments, the waveguides may be square, rectangular, triangular, etc. The concentric waveguide and waveguide cross sections described herein are applicable to structures with one or more planes of symmetry.

Figure 10:
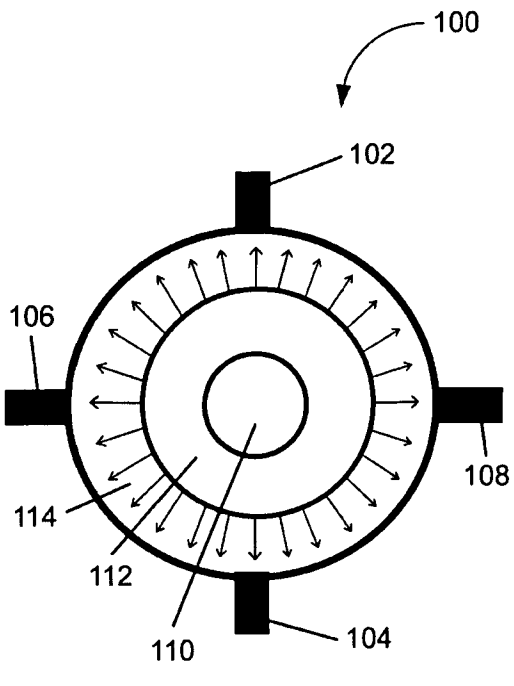
FIG. 10 is a diagram of a delta mode pattern for a feed with three waveguides, according to an exemplary embodiment.
Figure 9:
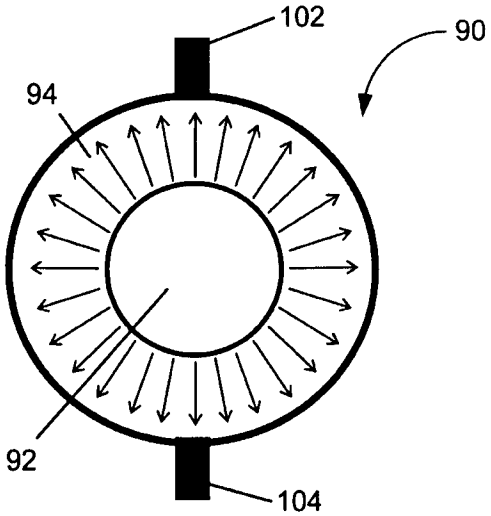
FIG. 9 is a diagram of a delta mode pattern for a feed with two waveguides, according to an exemplary embodiment.

Referring generally to FIGS. 8-10, a monopulse extension of an antenna feed is shown, according to an exemplary embodiment. The feeds of FIGS. 8-10 may be configured to generate both a sum beam and difference beam, and the sum and difference beam may be used to generate a monopulse signal. FIGS. 8-10 illustrate various feed configurations that vary in the number of probes and/or waveguides included in the feed.

Referring now to FIGS. 8-10, monopulse operation for feeds 80, 90, 100 are shown in greater detail, according to an exemplary embodiment. FIGS. 8 and 9 are illustrations of feeds with two concentric waveguides, while the embodiment of FIG. 10 illustrates three band waveguides (feed 20 of FIG. 2 illustrates an embodiment with four band waveguides). Feeds may have two, three, four, or any other number of waveguides. Various configurations are possible beyond the embodiments shown (e.g., the feed may have either two or four probes and either two, three, or four waveguide-towaveguide coupling slots or other ways of exciting the waveguide). Feed 80 illustrates a sum beam or sum mode while feeds 90, 100 illustrate a difference (delta) beam mode.

Feeds 80, 90, 100 are shown including two or four probes coupled to the outer waveguide of the feeds. The probes may be configured to receive a signal at a specific frequency and phase (e.g., exciting the probe) and provide the signal to an antenna coupled to the feed. The probes are electric field probes that create a transition between coaxial cable sections and the waveguide via electric field coupling between the probes and waveguide cross section, according to an exemplary embodiment. Feeds 80, 90, 100 may further include probes coupled to the inner waveguides of the feeds (not shown in FIGS. 8-10).

Feed 80 includes two waveguides 82, 84. Probe pairs are configured to realize the sum and difference patterns for monopulse operation. If sum-only patterns are required, then configurations of only one or two probe s may be used. According to some exemplary embodiments, some waveguides may perform in sum beam only modes while other waveguides perform in sum/delta modes, depending on the application.

Each waveguide section of feed 80 has its own set of probes. Feed 80 of FIG. 8 is shown with two pairs of probes (probes 102, 104, and probes 106, 108) coupled to outer waveguide 84. Feed 80 may include a pair of probes 102, 104 that are diametrically opposed and form an axis. Probes 102, 104 are coupled to one of the concentric waveguides of feed 80. Feed 80 further includes another pair of probes 106, 108 that are diametrically opposed and form a second axis. Probes 106, 108 are coupled to one of the concentric waveguides of feed 80. According to an exemplary embodiment, one or more concentric waveguides of feed 20 may be coupled to a set of four probes (e.g., the outer waveguide 84 shown in FIG. 8 may be coupled to probes 102, 104, 106, 108). According to another exemplary embodiment, one or more of the concentric waveguides of feed 20 may be coupled to a set of two probes. Outer waveguide 84 is shown coupled to probes 102, 104, 106, 108 and is shown with a generated sum beam or sum mode. Waveguide 82 is an inner waveguide and may be coupled to two or four additional probes (not shown in FIG. 8).

In the embodiment of FIG. 9, feed 90 is shown with just two probes 102, 104, that are diametrically opposed and form an axis (e.g., a vertical axis or horizontal axis with respect to the antenna, or any other axis). Different sets of probe pairs 102, 104 are requires for each waveguide 92, 94 of feed 90. In the embodiment of FIG. 10, three waveguides 110, 112, 114 are shown along with two pairs of probes 102, 104 and 106, 108 for the outer ring or waveguide 114 of feed 100. Different sets of probes 102, 104, 106, 108 are required for each of the three waveguides 112, 114, 116, according to an exemplary embodiment. Feeds 90, 100 show waveguides 94, 114 with generated difference beams or delta modes.

Referring generally to probes 102, 104, 106, 108 of FIGS. 8-10, the probes may be configured to generate a sum beam and a difference beam in each of the waveguides of the feeds. With reference to FIG. 8, a sum mode configuration is shown. Probes 102, 104 are driven in phase to produce a vertical linear polarized signal, according to an exemplary embodiment. With reference to FIG. 9, a difference beam (e.g. a delta mode) configuration is shown. Probes 102, 104 are driven out of phase to produce a horizontal linear polarized signal, according to an exemplary embodiment. Probes 102, 104 may form an axis that is orthogonal to the axis formed by probes 106, 108.

With reference to a four-probe embodiment of a feed (e.g., feed 80 or 100), according to one exemplary embodiment, the probes are excited as pairs (e.g., probe 102 is paired with probe 104 and probe 106 is paired with probe 108). Such a configuration generates a vertical (from pair of probes 102, 104) or horizontal (from pair of probes 106, 108) sum beam in at least one of the waveguides of the feed 80 (the waveguide(s) coupled to the excited probes). According to another exemplary embodiment, both probes of one pair of probes (e.g., either probes 102 and 104 or probes 106 and 108) may be excited such that the field they generate with the waveguide are in phase to generate a vertical or horizontal sum beam (dependent upon the location of the paired probe on the feed) in at least one waveguide of feed 80 (the waveguide(s) coupled to the excited pair of probes). This field configuration is illustrated in FIG. 8. According to yet another exemplary embodiment, both probes of one pair of probes may be excited such that the field they generate are out of phase to generate a vertical or horizontal difference beam (dependent upon the location of the paired probe on the feed) in one of the waveguides of feed 100 (the waveguide(s) coupled to the excited pair of probes). This field configuration is illustrated in FIG. 9.

Referring further to feed 80, both probe pairs (probes 102, 104 and 106, 108) may be excited to generate a sum beam with left hand or right hand circular polarization for the waveguides coupled to the excited probes.

Referring further to feed 80, both pairs of probes may both be excited in phase with each other (e.g., probes 102 and 104 are excited in phase with each other and probes 106 and 108 are excited in phase with each other) and the probe pair combination 102, 104 is fed 90 degrees out of phase with probe pair combination 106, 108. A sum beam with left hand or right hand circular polarization is generated at a given time period for the waveguides coupled to the excited probes. Referring further to feed 100, with both pairs of probes, each probe is in phase with each other. The probe pair combination 102, 104 is fed 90 degrees out of phase with probe pair combination 106, 108 to generate a difference beam with left hand or right hand circular polarization. According to an exemplary embodiment, both pairs of probes may be excited to switch between a generation of a sum beam and a generation of a difference beam. The switching generates a monopulse operation by sequencing between sum and difference modes within each ring.

Figure 11:
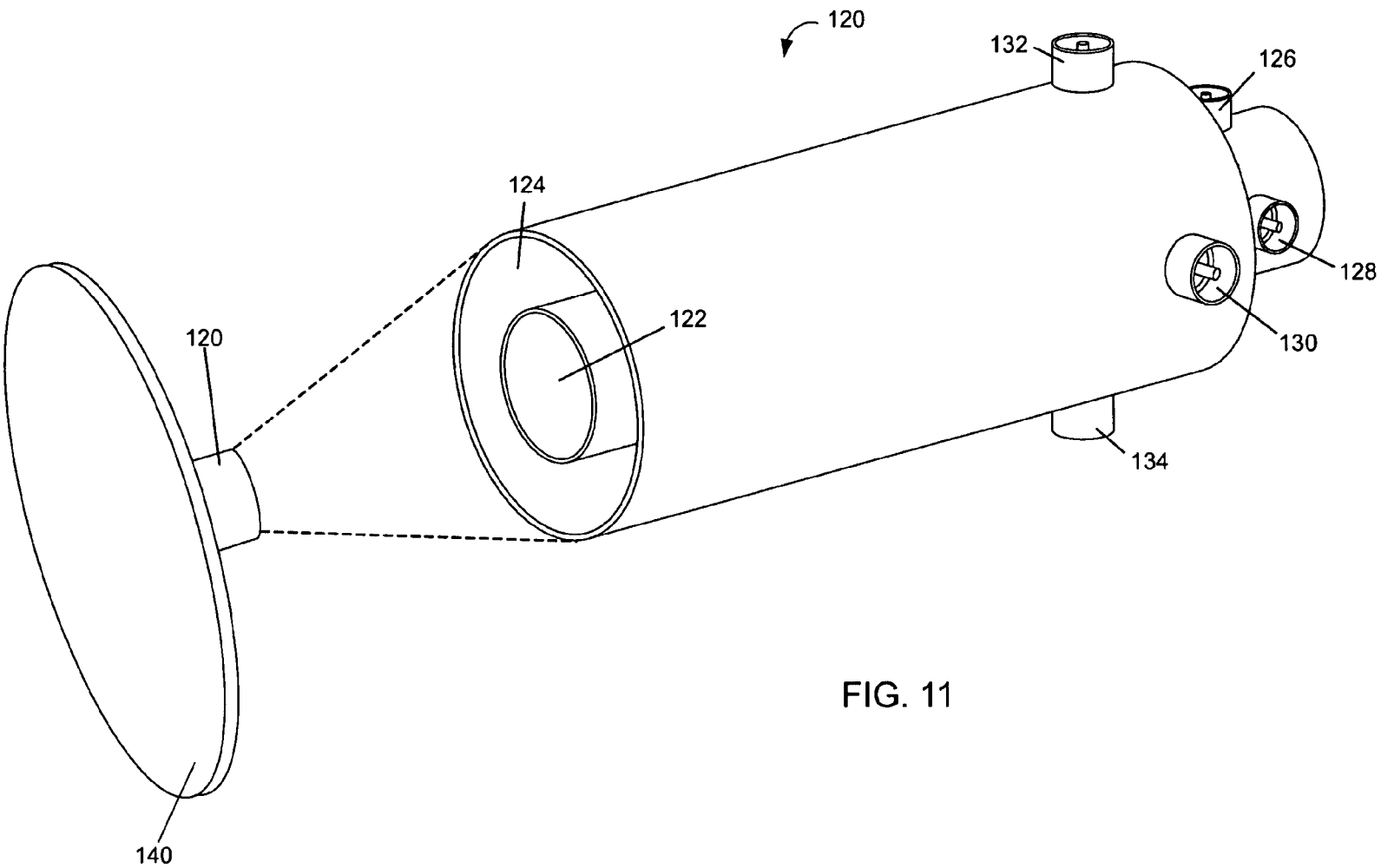
FIG. 11 is a perspective view of an antenna coupled to a feed with two waveguides and probes, according to an exemplary embodiment.

Referring now to FIG. 11, feed 120 is shown, which implements the concepts described in the embodiments of FIGS. 8-10, according to an exemplary embodiment. This embodiment shows the feed used in conjunction with a prome focus reflecting surface. The transmitted wave of reflector antenna system 140 propagates to the left in FIG. 11. Feed 120 is shown with two waveguides 122, 124. Waveguide 122 may include four probes (probes 126, 128 and two probes not shown). Waveguide 124 may also include four probes (probes 130, 132, 134 and another probe not shown).

Figure 12:
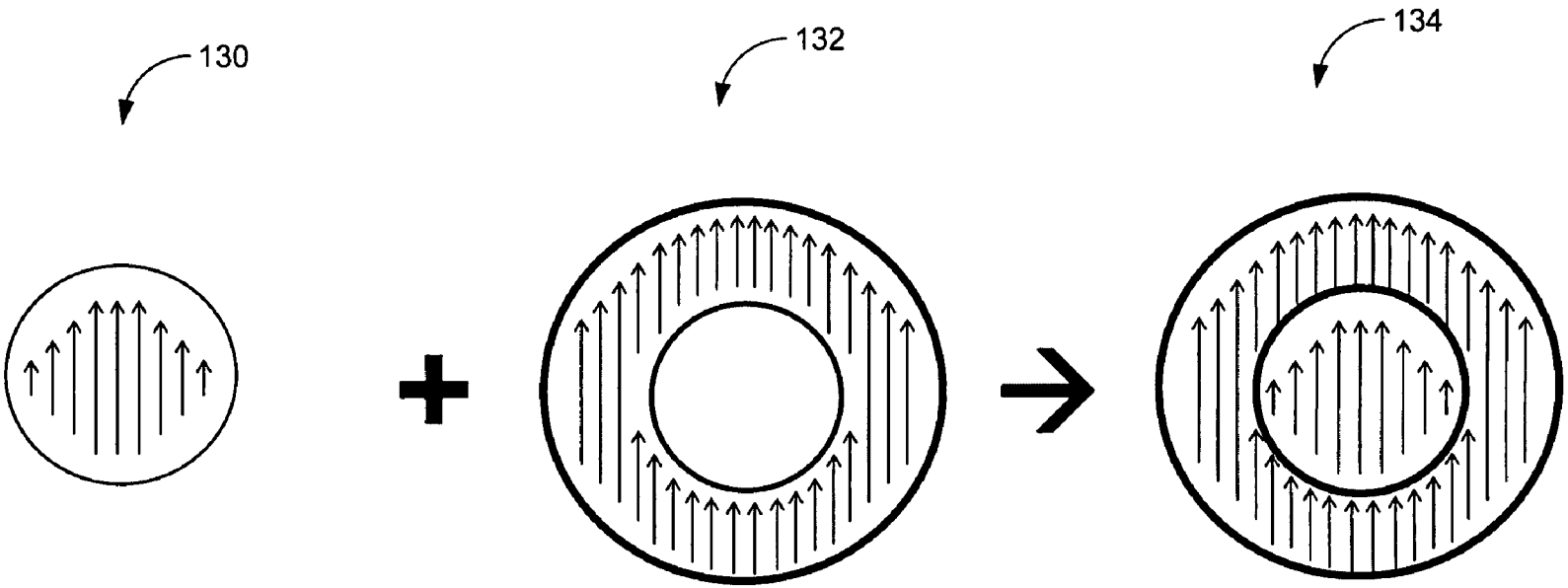
FIG. 12 is a diagram of two concentric waveguides coupling to form a feed, according to an exemplary embodiment

Referring now to FIG. 12, two waveguides 130, 132 are shown. Concentric waveguides 130, 132 may be combined as shown to form a feed 134 with two waveguides, according to an exemplary embodiment. In the embodiment of FIG. 12, band waveguide 130 may be a "hard" waveguide while band waveguide 132 may be a "hard" coaxial waveguide. Feed 134 may feature the advantages and construction as described generally in FIGS. 2-7. The waveguide wall surface treatments are used to produce an electromagnetic hard surface.

Referring further to FIG. 11, feed 120 is coupled to an antenna or reflector 140, according to an exemplary embodiment. Feed 120 is blown up to better illustrate the details of feed 120. Feed 120 may accept an input power at the various probes (probes 126-134) and may provide antenna 140 with an output power for transmittal. The interaction between feed 120 and antenna 140 is described in greater detail in FIGS. 14A-B. In the prime focus reflector exemplary embodiment shown, the apertures of waveguides 124 and 122 (the non-connected, open ends) point towards the interior curved surface of reflector 140 to direct signals to reflector 140. While feed 120 is shown with a particular reflector configuration, according to other exemplary embodiments feed 120 may be any of numerous reflector configurations.

Figure 13:
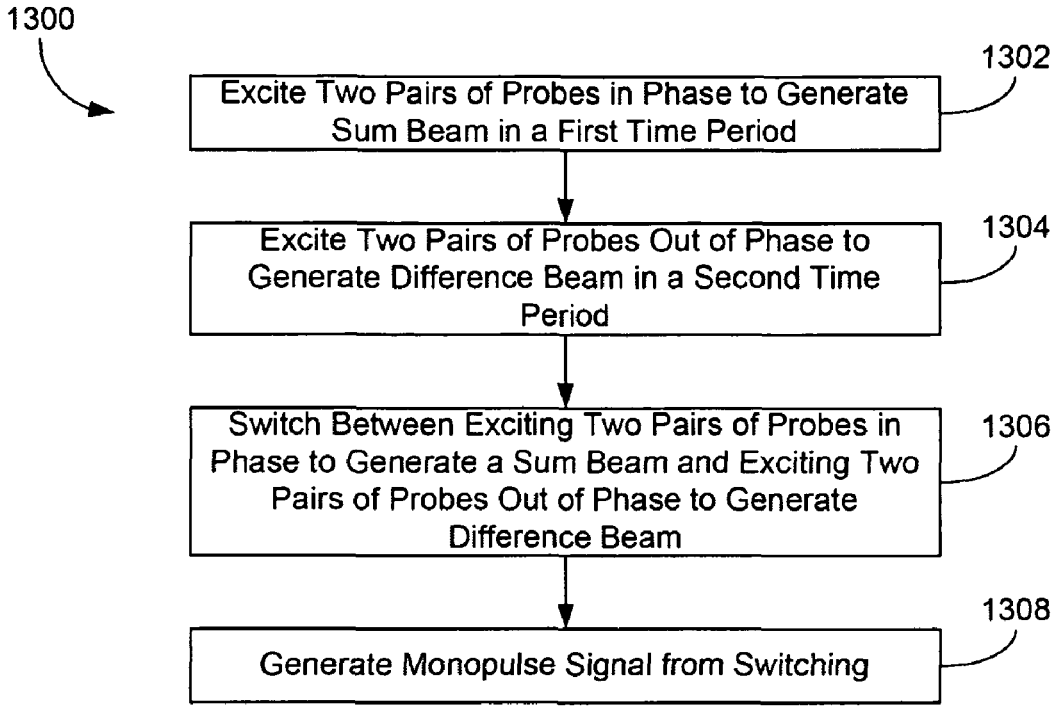
FIG. 13 is a flow chart of a process of producing a monopulse signal, according to an exemplary embodiment.

Referring to FIG. 13, a flow diagram of a method 1300 of generating a monopulse signal in at least one waveguide of a feed is shown, according to an exemplary embodiment. The feed may include two or more concentric waveguides, at least one of which is coupled to a first pair and second pair of probes (for four probes in total). During a given time period, both probes of a first pair of probes may be excited in phase with each other and both probes of the second pair of probes may be excited in phase with each other in order to generate a sum beam (step 1302). According to an exemplary embodiment, the sum beam may have left-hand or right-hand circular polarization. During a given time period separate from the time period in step 1302, both probes of the first pair of probes may be excited out of phase and both probes of the second pair of probes may be excited out of phase in order to generate a difference beam (step 1304). According to an exemplary embodiment, the difference beam may have left-hand or right-hand circular polarization.

Method 1300 further includes switching between exciting the probes in phase to generate a sum beam as described in step 1302 and exciting the probes out of phase to generate a difference beam as described in step 1304 (step 1306). The switching of the excitements generates a monopulse signal (step 1308). Method 1300 may be used for satellite communication or for radar transmission and reception.

Figure 14A:
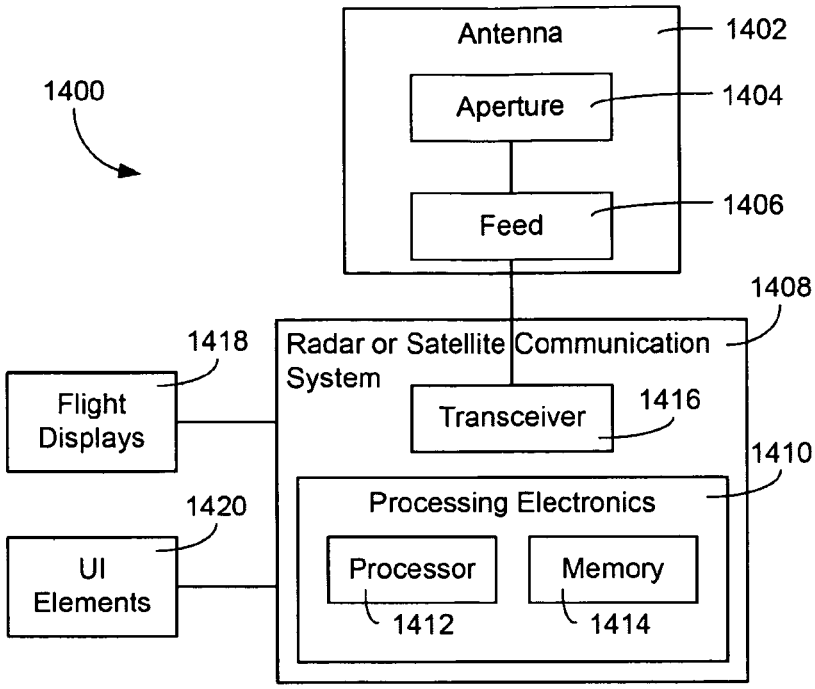
FIGS. 14A and 14B are block diagrams of radar or satellite communication systems and antennas including the feeds as disclosed in the present application, according to an exemplary embodiment.
Figure 14B:
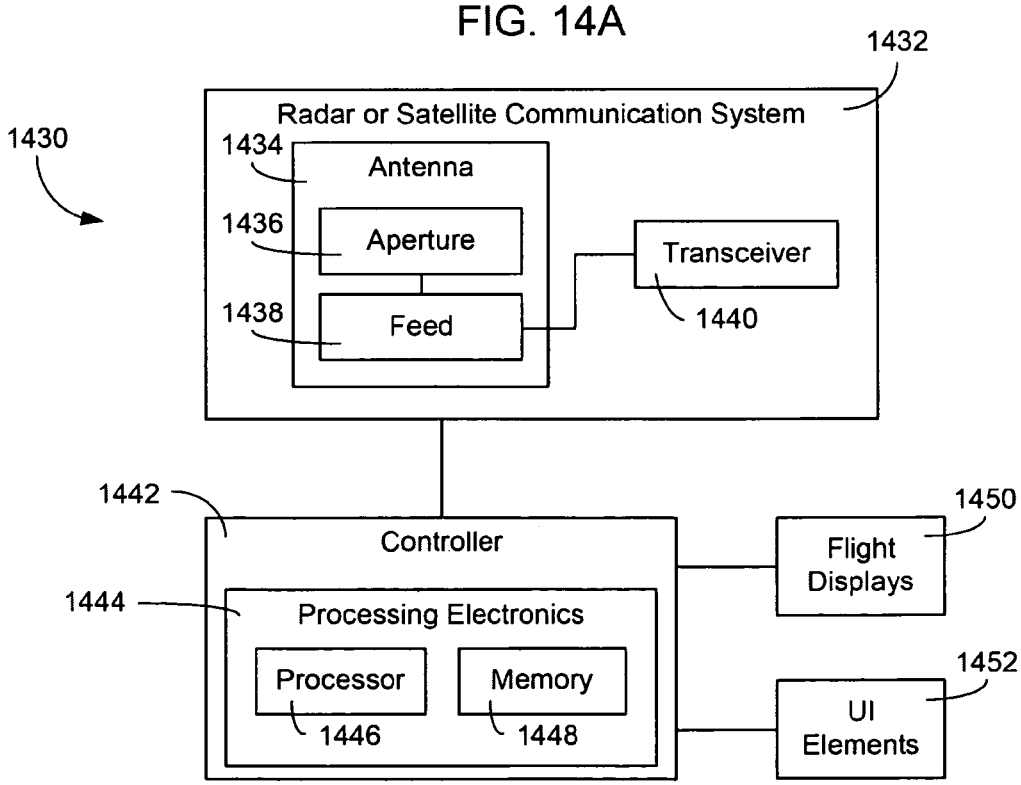

Referring generally to FIGS. 14A-B, block diagrams of radar or satellite communication systems are shown, according to an exemplary embodiment. Referring to FIG. 14A, an antenna 1402 is shown coupled to radar or satellite communication system 1408, according to an exemplary embodiment. Antenna 1402 includes an aperture 1404 coupled to feed 1406 (e.g., the feed as described in the present disclosure. Radar or satellite communication system 1408 is additionally coupled to flight displays 1418 and User Interface (UI) elements 1420 and includes a transceiver 1416 and processing electronics 1410.

Antenna 1402 may receive radar returns from a target. Radar or satellite communication system 1408 includes a receive circuit or other circuitry configured to receive data from antenna 1402 (e.g. radar returns) and to provide the data to processor 1412. Radar or satellite communication system 1408 additionally includes transceiver 1416 for transmitting and receiving signals via antenna 1402.

Radar or satellite communication system 1408 includes processing electronics 1410 or other circuitry for various analysis (e.g., weather and ground analysis based on geography, time, etc.). Processing electronics 1410 includes processor 1412 and memory 1414. Processor 1412 may store information in memory 1414 to be retrieved for later use. According to various exemplary embodiments, processor 1412 can be any hardware and/or software processor or processing architecture capable of executing instructions and operating on data related to the radar returns. Furthermore, memory 1414 can be any volatile or non volatile memory.

Radar or satellite communication system 1408 may provide output data to flight displays 1418 for display. Radar or satellite communication system 1408 may further be configured to receive user inputs from UI elements 1420 to adjust the features of flight displays 1418.

Referring to FIG. 14B, a radar or satellite communication system 1432 is shown to include antenna 1434, according to an exemplary embodiment. Radar or satellite communication system 1432 further includes transceiver 1440 for transmitting and receiving signals via antenna 1434. Antenna includes an aperture 1436 for receiving an input and feed 1438. A controller 1442 may be coupled to radar or satellite communication system 1432 and includes processing electronics 1444 with processor 1446 and memory 1448. Processing electronics may have the same functionality of processing electronics 1410 of FIG. 14A. Flight displays 1450 and UI elements 1452 are coupled to controller 1442 and may have the same functionality as flight displays 1418 and UI elements 1420 of FIG. 14A.

While the detailed drawings, specific examples, detailed algorithms, and particular configurations given describe preferred and exemplary embodiments, they serve the purpose of illustration only. The inventions disclosed are not limited to the specific forms shown. For example, the methods may be performed in any of a variety of sequence of steps or according to any of a variety of mathematical formulas. The hardware and software configurations shown and described may differ depending on the chosen performance characteristics and physical characteristics of the radar and processing devices. For example, the type of system components and their interconnections may differ. The systems and methods depicted and described are not limited to the precise details and conditions disclosed. The flow charts show preferred exemplary operations only. The specific data types and operations are shown in a non-limiting fashion. Furthermore, other substitutions, modifications, changes, and omissions may be made in the design, operating conditions, and arrangement of the exemplary embodiments without departing from the scope of the invention as expressed in the appended claims.

What is claimed is:

1. A feed for an antenna, the antenna configured for use with a radar system or a satellite communication system, the feed configured to operate in multiple bands, the feed comprising:

a plurality of concentric waveguides;

a first pair of diametrically opposed probes forming a first axis and electrically coupled to at least one of the plurality of concentric waveguides; and a second pair of diametrically opposed probes forming a second axis and electrically coupled to the at least one of the plurality of concentric waveguides, the first axis and second axis being orthogonal, the first and second pairs of diametrically opposed probes configured to generate a sum beam and a difference beam in the at least one of the plurality of concentric waveguides;

a third pair of diametrically opposed probes disposed along the first axis and a fourth pair of diametrically opposed probes disposed along the second axis, wherein the third pair and the fourth pair are electronically coupled to an inner concentric waveguide of the plurality of concentric waveguides.

2. The feed of claim 1, wherein an outer concentric waveguide of the plurality of concentric waveguides is electrically coupled to the first pair of the diametrically opposed probes, the third and fourth pairs configured to generate a sum beam and a difference beam in the inner concentric waveguide of the plurality of concentric waveguides.

3. The feed of claim 1, wherein a single probe of one of the first and second pairs of diametrically opposed probes is excited to generate a vertical or horizontal sum beam in the at least one of the plurality of concentric waveguides.

4. The feed of claim 1, wherein both probes of one of the first and second pairs of diametrically opposed probes can be excited in phase with each other to generate a vertical or horizontal sum beam in the at least one of the plurality of concentric waveguides and can be excited out of phase with each other to generate a vertical or horizontal difference beam in the at least one of the plurality of concentric waveguides.

5. The feed of claim 1, wherein one probe of each of the first and second pairs of diametrically opposed probes are excited to generate sum beam with left-hand or right-hand circular polarization in the at least one of the plurality of concentric waveguides.

6. The feed of claim 1, wherein both probes of the first pair of diametrically opposed probes are excited in phase with each other and both probes of the second pair of diametrically opposed probes are excited in phase with each other to generate a sum beam with left-hand or right-hand circular polarization in the at least one of the plurality of concentric waveguides at a first time period.

7. The feed of claim 6, wherein both probes of the first pair of diametrically opposed probes are excited out of phase with each other and both probes of the second pair of diametrically opposed probes are excited out of phase with each other to generate a difference beam with left-hand or right-hand circular polarization in the at least one of the plurality of concentric waveguides at a second time period.

8. The feed of claim 7, wherein the first and second pairs of diametrically opposed probes are excited to switch between generation of the sum beam and difference beam in the at least one of the plurality of concentric waveguides to generate a monopulse signal in the at least one of the plurality of concentric waveguides.

9. The feed of claim 1, wherein the plurality of concentric waveguides comprises 2, 3, 4 or more concentric waveguides.

10. The feed of claim 1, wherein the antenna is configured for mounting to at least one of an aircraft, a land vehicle, portable equipment, a water vehicle, and a space vehicle and is configured for use in satellite communications or for radar transmission/reception.

11. A method for generating a sum and difference beam in an antenna feed, the antenna feed configured for use with a radar system or a satellite communication system, the antenna feed configured to operate in multiple bands, the antenna feed having a plurality of concentric waveguides, a first pair of diametrically opposed probes forming a first axis and electrically coupled to at least one of a first waveguide of the plurality of concentric waveguides, a second pair of diametrically opposed probes forming a second axis and electrically coupled to the first waveguide of the plurality of concentric waveguides, a third pair of probes and a fourth pair of probes, the third and fourth pair being electronically coupled to a second waveguide of the concentric wave guides, the first and second axis being orthogonal, the method comprising:

generating a first sum beam and a first difference beam in a first of the plurality of concentric waveguides using the first pair and the second pair; and generating a second sum beam and a second difference beam in the second concentric waveguide of the wave guides using the third pair and the fourth pair.

12. The method of claim 11, wherein each of the plurality of concentric waveguides is electrically coupled to the first pair of diametrically opposed probes and the second pair of diametrically opposed probes.

13. The method of claim 11, wherein generating the sum beam in the at least one of the plurality of concentric waveguides comprises exciting a single probe of one of the first and second pairs of diametrically opposed probes, the sum beam being a vertical or horizontal sum beam.

14. The method of claim 11, wherein generating the sum beam in the at least one of the plurality of concentric waveguides comprises exciting both probes of one of the first and second pairs of diametrically opposed probes in phase with each other, the sum beam being a horizontal or vertical difference beam, and wherein generating the difference beam in the at least one of the plurality of concentric waveguides comprises exciting both probes of one of the first and second pairs of diametrically opposed probes out of phase with each other, the difference beam being a vertical or horizontal difference beam.

15. The method of claim 11, wherein generating the sum beam in the at least one of the plurality of concentric waveguides comprises exciting one probe of each of the first and second pairs of diametrically opposed probes, the sum beam having left-hand or right-hand circular polarization.

16. The method of claim 11, wherein generating the sum beam in the at least one of the plurality of concentric waveguides comprises exciting both probes of the first pair of diametrically opposed probes in phase with each other and exciting both probes of the second pair of diametrically opposed probes in phase with each other at a first time period, the sum beam having left-hand or right-hand circular polarization.

17. The method of claim 16, wherein generating the difference beam in the at least one of the plurality of concentric waveguides comprises exciting both probes of the first pair of diametrically opposed probes out of phase with each other and exciting both probes of the second pair of diametrically opposed probes out of phase with each other at a second time period, the difference beam having left-hand or right-hand circular polarization.

18. The method of claim 17, further comprising: switching between the sum beam and the difference beam in the at least one of the plurality of concentric waveguides to generate a monopulse signal.

19. The method of claim 11, further comprising: switching between the sum beam and the difference beam in the at least one of the plurality of concentric waveguides to generate a monopulse signal, the monopulse signal being generated by a vertical linear polarization, a horizontal linear polarization, a left-hand circular polarization, or a right-hand circular polarization electric field configuration.

20. An apparatus for generating a radar beam in an antenna, the antenna configured for use with a radar system or a satellite communication system, comprising:

a plurality of concentric waveguides;

a first pair of diametrically opposed probes forming a first axis and electrically coupled to a first waveguide of a plurality of concentric waveguides;

a second pair of diametrically opposed probes forming a second axis and electrically coupled to the first waveguide of the plurality of concentric waveguides, the first axis and second axis being orthogonal;

a third pair of probes and a fourth pair of probes being electrically coupled to a second waveguide of the concentric waveguides at a portion of the second waveguide extending from the first waveguide;

means for exciting both probes of the first pair of diametrically opposed probes in phase with each other and exciting both probes of the second pair of diametrically opposed probes in phase with each other at a first time period;

means for exciting both probes of the first pair of diametrically opposed probes out of phase with each other and exciting both probes of the second pair of diametrically opposed probes out of phase with each other at a second time period; and means for switching between the sum beam and the difference beam in the first waveguide of the plurality of concentric waveguides to generate a monopulse signal.

* * * * *